US005918455A

United States Patent [19]

Matas Gabalda et al.

[11] Patent Number: 5,918,455

[45] Date of Patent: Jul. 6, 1999

[54] DRAWING/FALSE-TWIST-TEXTURIZING PROCESS AND NOVEL TYPE OF OVEN ENABLING IT TO BE IMPLEMENTED

[75] Inventors: Carlos Matas Gabalda, Granges les Valence; Pierre Mirabel, Roanne, both of France

[73] Assignee: ICBT Roanne, France

[21] Appl. No.: 08/849,269

[22] PCT Filed: Oct. 16, 1995

[86] PCT No.: PCT/FR95/01361

§ 371 Date: May 16, 1997

§ 102(e) Date: May 16, 1997

[87] PCT Pub. No.: WO96/16210

PCT Pub. Date: May 30, 1996

[30] Foreign Application Priority Data

Nov. 22, 1994 [FR] France ..... 94 14245
Jul. 19, 1995 [FR] France ..... 95 08982

[51] Int. Cl.[6] ..... D01H 7/46

[52] U.S. Cl. ..... 57/290; 57/352

[58] Field of Search ..... 57/290, 352, 284; 28/249; 34/68, 164, 624, 628, 647; 219/388

[56] References Cited

U.S. PATENT DOCUMENTS

| | | | |
|---|---|---|---|
| 3,152,436 | 10/1964 | Dudzik et al. | 57/157 |
| 4,567,721 | 2/1986 | Kuroda et al. | 57/284 |
| 4,648,240 | 3/1987 | Hallsworth et al. | 57/288 |
| 5,138,829 | 8/1992 | Tanae et al. | 57/290 |
| 5,193,293 | 3/1993 | Gabalda et al. | 57/68 |
| 5,332,882 | 7/1994 | Gabalda et al. | 219/388 |
| 5,359,845 | 11/1994 | Gabalda et al. | 57/290 |
| 5,471,828 | 12/1995 | King | 57/290 |
| 5,628,175 | 5/1997 | Fischer | 57/290 |
| 5,628,176 | 5/1997 | Morhenne et al. | 57/290 |
| 5,666,797 | 9/1997 | Bruske et al. | 57/290 |

FOREIGN PATENT DOCUMENTS

| | | |
|---|---|---|
| 0412429 | 8/1990 | European Pat. Off. . |
| 0524111 | 5/1992 | European Pat. Off. . |
| 0578589 | 6/1993 | European Pat. Off. . |
| 2695654 | 3/1993 | France . |
| 2695655 | 7/1993 | France . |

*Primary Examiner*—William Stryjewski
*Attorney, Agent, or Firm*—Wall Marjama Bilinski & Burr

[57] ABSTRACT

A drawing/false twist texturizing process capable of being implemented during the treatment of the yarn. During the treatment, the point of striction is localized during the drawing phase by bringing about an abrupt break or modification in the trajectory of the yarn while it is rising in temperature in the texturizing zone. This is achieved by pressing on a surface or element allowing the twist imparted by the false-twisting spindle to be taken back as far as the first feed system. The modification in the trajectory of the yarn is achieved in the actual oven either while the yarn is rising in temperature or in the vicinity of the zone where it reaches its optimum treatment temperature.

5 Claims, 5 Drawing Sheets

DRAWING/FALSE-TWIST-TEXTURIZING PROCESS AND NOVEL TYPE OF OVEN ENABLING IT TO BE IMPLEMENTED

BACKGROUND OF THE INVENTION

The present invention relates to an improvement made to false-twist-texturizing techniques and relates more particularly to a novel type of process capable of being implemented on machines enabling partially oriented or unoriented yarns to be treated, at high speed, generally at speeds greater than 1000 m/min, the yarn being drawn during the texturizing operation.

To date, two known techniques, one known by the expression "sequential drawing/texturizing" and the other by the expression "simultaneous drawing/texturizing", are employed on false-twist-texturizing machines, depending on the nature of the yarns treated.

In the "sequential drawing/texturizing" technique, the machine is designed in such a way that the drawing and texturizing operations are carried out in succession in two separate zones. A simple juxtaposition of well-known operations is therefore carried out, which enables the operational conditions both in the drawing zone and the texturizing zone proper to be completely controlled, depending on the nature of the yarns treated. However, this technique has the drawback of leading to machines which are complex and tricky to employ.

Consequently, the technique used most nowadays is the technique called "simultaneous drawing/texturizing" in which the drawing phase is carried out on the yarn in the twisted state upstream of the false-twisting spindle, simply by adjusting the speeds between the two yarn-feed systems provided upstream of the oven and downstream of the false-twisting spindle. However, this technique causes implementation problems, especially in the case of polyester yarns for which it is known to be necessary to control completely the zone where the point of striction occurs.

Now, an improved drawing/false-twist-texturizing process has been found, and it is this which forms the subject of the present invention, which makes it possible not only to retain the advantages of machines employing the simultaneous drawing/texturizing process, but also those of the sequential drawing/texturizing technique, by virtue of which improvement it is possible to localize the point of striction of the yarn during the drawing phase very precisely, this being an absolutely necessary condition especially in the case of treating polyester yarns.

SUMMARY OF THE INVENTION

In general, the invention therefore relates to a drawing/false-twist-texturizing process capable of being implemented on a machine consisting, in a known way, of a plurality of identical work positions mounted on a support frame, each position comprising, in the direction of movement of the yarn during its treatment:

- a creel for supplying unoriented or partially oriented yarn to be treated;
- a feed system enabling the yarn to be delivered at a predetermined speed into the texturizing zone proper, which zone consists of an oven, a cooling track and a false-twisting spindle;
- a second feed, the speed of which is greater than the first, having a value corresponding to the degree of drawing to be carried out on the yarn;
- means for winding up the drawn and texturized yarn, these optionally being preceded by a heatresetting oven with a third feed located immediately in front of the reception.

The process in accordance with the invention is characterized in that the point of striction on the yarn during the drawing phase is localized by bringing about a sudden break or modification in the trajectory of the yarn while it is rising in temperature in the texturizing zone, this being achieved by pressing on a surface or element allowing the twist imparted by the spindle to be taken back as far as the first feed system.

By virtue of such a procedure, which goes counter to what is generally accepted in the texturizing field where one of the desired conditions for obtaining good uniformity of the texturized yarn is that the path of the said yarn should be rectilinear in the zone going from the first delivery unit to the exit of the false-twisting spindle, it has been observed that the quality of the yarns produced was superior, especially in the case of polyester yarns.

Such a break in the trajectory of the yarn, which enables the point of striction to be localized, can possibly be carried out by providing additional yarn preheating and path-deviating means before the yarn enters the oven proper. Preferably, the break in the trajectory is carried out within the actual oven by adapting the said oven so that the change in trajectory occurs while the yarn is rising in temperature, and preferably in the vicinity of the zone where it reaches, within the oven, its optimum treatment temperature.

Such a process is particularly suitable for go application to ovens called "high-temperature" ovens which are being increasingly provided on false-twist-texturizing machines in order to reduce the length of the heat treatment zone, such as those forming the subject of U.S. Pat. No. 5,193,293 (corresponding to EP-A-524,111), the content of which is incorporated as a requirement of the present description.

In general, the type of oven forming the subject of the aforementioned patent, comprising a heater unit proper, which includes a succession of cylindrical zones having different diameters, these being arranged directly in line with one another, the yarn to be treated being held at a constant distance from the external surface of the zones of small diameter in such a way that the temperature rise of the yarn in these zones occurs by radiation, whereas it comes into contact with the surface of the zones of large diameter, the heat transfer then taking place by contact, yarn-guiding elements being provided over the length of the oven in order to position the yarn.

This type of oven for implementing the process in accordance with the invention is characterized in that it includes, going along the trajectory of the yarn, an entry zone, where the heating takes place by radiation, followed by a zone for heating by contact, after which zone means are arranged enabling the trajectory of the yarn to be modified without, however, preventing the twist from going back, the said trajectory subsequently becoming uniform again, whether rectilinear or curvilinear, the yarn then being subjected to a succession of heat treatments by contact and by radiation right up to the point where it leaves the oven, the final zone advantageously consisting of a zone for heating by radiation.

It has been observed that, for an oven allowing high-temperature treatment (of the order of 600° C. to 800° C.), having a length of the order of one meter, an entry zone and an exit zone allowing heating by radiation, each having a length of 100 mm, make it possible to obtain very good textile characteristics on the yarns to be treated, especially in the case of polyester yarns. In such a type of oven, the intermediate zone lying between the entry zone and the exit zone is designed to allow, as stated above, a combination of heating by radiation and heating by contact, the length of the various zones being adapted according to the yarns to be treated.

Advantageously, in such a type of oven design, the zones of different diameters, enabling such a combination of heating by radiation and heating by contact to be achieved, are produced in a similar manner to the teachings of European Patent EP-A-578,589 (which patent corresponds to U.S. Pat. No. 5,332,882), the design of which is such that the active element called the "heater unit" may be easily unfitted and fitted again, either to carry out maintenance operations such as cleaning or possibly to replace a heater unit of given structure by a different unit when it is desired to modify the heat treatment, for example when it is necessary to treat a different kind of yarn.

In such an oven for implementing the process in accordance with the invention, and which is therefore designed in such a way that one of the end faces of the shroud surrounding the insulating chamber and the heater unit is removable and supports all the connections making it possible to provide the electrical supply for the oven, its control, etc., the heater unit being fixed via one of its ends to the said removable face, in accordance with the improvement according to the invention, the zones of different diameters, enabling the combination of heating by radiation and heating by contact to be achieved, consist of a plurality of elementary modules juxtaposed by fitting together on the cylindrical heater which is fixed via one of its ends to the removable face of the oven shroud, the said juxtaposed modules being held in position by a positioning and locking element which is itself fastened to the said removable face.

In one such embodiment, the oven is advantageously designed for treating two yarns in parallel, the yarns being guided and positioned inside the oven, between the point of entry through little holes provided on the face and the point of exit through little holes provided at the other end of the oven, by means of guides distributed over the length of the heating assembly, an arrangement which thus makes it possible to modify the path of the yarns, which may be either rectilinear or, preferably, may form one or two helices over the length of the oven between the entry zone and the exit zone where the path is rectilinear.

In such a type of oven, the point of striction is localized in the entry zone, either while the yarn is rising in temperature or when it has reached approximately the normal treatment temperature, by means of a large-diameter module with which the yarn or yarns are in contact and after leaving this module they are deflected, thereby bringing about an abrupt break or modification in the trajectory of the said yarn, in which zone the point of striction is localized.

By virtue of such an oven design, it is therefore possible not only to localize precisely the zone where drawing of the yarn takes place, but it is also possible to adapt the heating elements to each type of treatment simply by substituting or combining elementary modules allowing a succession of heating by contact and heating by radiation, the lengths of which may be adapted according to the yarns, the heater proper being the same for any type of yarn.

The invention and the advantages it brings will, however, be better understood by means of the following description which is illustrated by the appended diagrams in which:

DETAILING DESCRIPTION OF THE INVENTION

Figure 1:
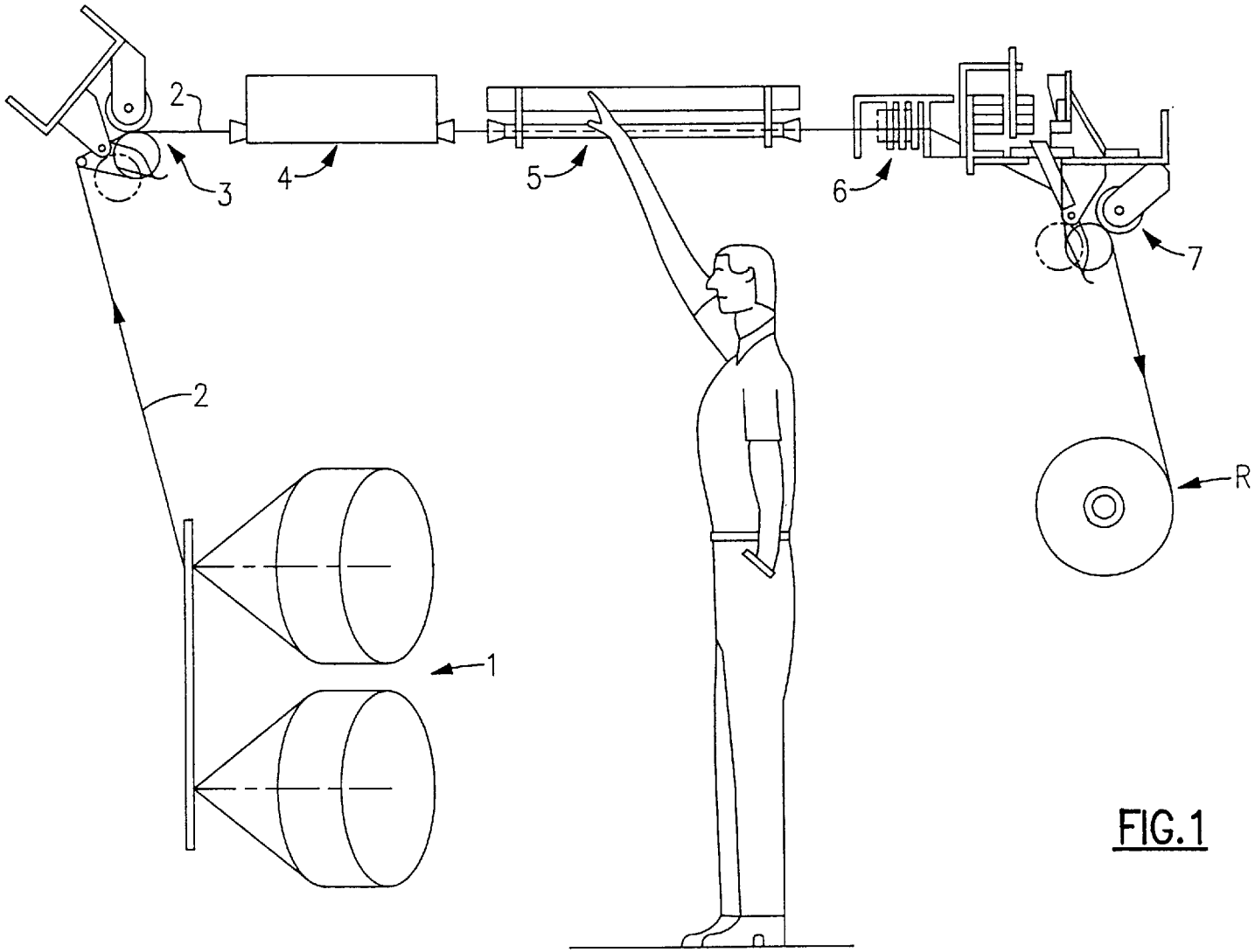
FIG. 1 diagrammatically illustrates, in side view, a working position of a machine capable of implementing the process in accordance with the invention.

Referring to the appended FIG. 1, each working position of the machine for implementing the process in accordance with the invention includes, as in any false-twist-texturizing machine:

- a creel (1) for supplying unoriented or partially oriented yarn (2) to be treated;
- a feed system (3) enabling the yarn (2) to be delivered at a predetermined speed into the texturization zone proper, which zone consists of an oven (4), a cooling track (5) and a false-twisting spindle (6);
- a second feed (7), the speed of which is greater than the first (3) by an amount corresponding to the degree of drawing to be carried out on the yarn (2) and;
- means (R) for winding up the drawn and textured yarn, these optionally being preceded by a thermal-resetting oven with a third feed arranged just in front of the reception.

In accordance with the invention, this machine includes means which make it possible to modify the trajectory of the yarn (2) while it is rising in temperature in the texturization zone, preferably right inside the oven (4) in the vicinity of the zone where it reaches its optimum treatment temperature, while at the same time allowing the twist imparted by the spindle (6) to be taken back as far as the first feed (3).

Such a break in the trajectory, which makes it possible to localize the point of striction during the drawing phase, may possibly be achieved by providing yarn (2) preheating and path-deflecting means before it enters the oven (4).

However, such means will preferably be integrated in the oven (4) itself.

Such a possibility of integrating the means which allow the point of striction to be localized within the oven itself may be achieved simply by adapting the ovens of the type forming the subject of Patents U.S. Pat. No. 5,193,293 and U.S. Pat. No. 5,332,882, mentioned in the preamble, considering that modifying the structure of other types of ovens known for obtaining such a change in the trajectory of the yarn does not extend beyond the scope of the invention.

In general, for implementing the invention, the oven will advantageously be of the type comprising a heater unit (B) proper which includes a succession of cylindrical zones (see FIG. 2) having different diameters D and d, these being arranged directly in line with one another. While it passes through the oven, the yarn (2) to be treated is kept at a constant distance from the sections of small diameter d, the rise in temperature in these zones occurring by radiation, whereas it is in contact with the surface of the zones of large diameter D.

Guiding means are provided over the length of the oven in order to position the yarn.

Figure 2:
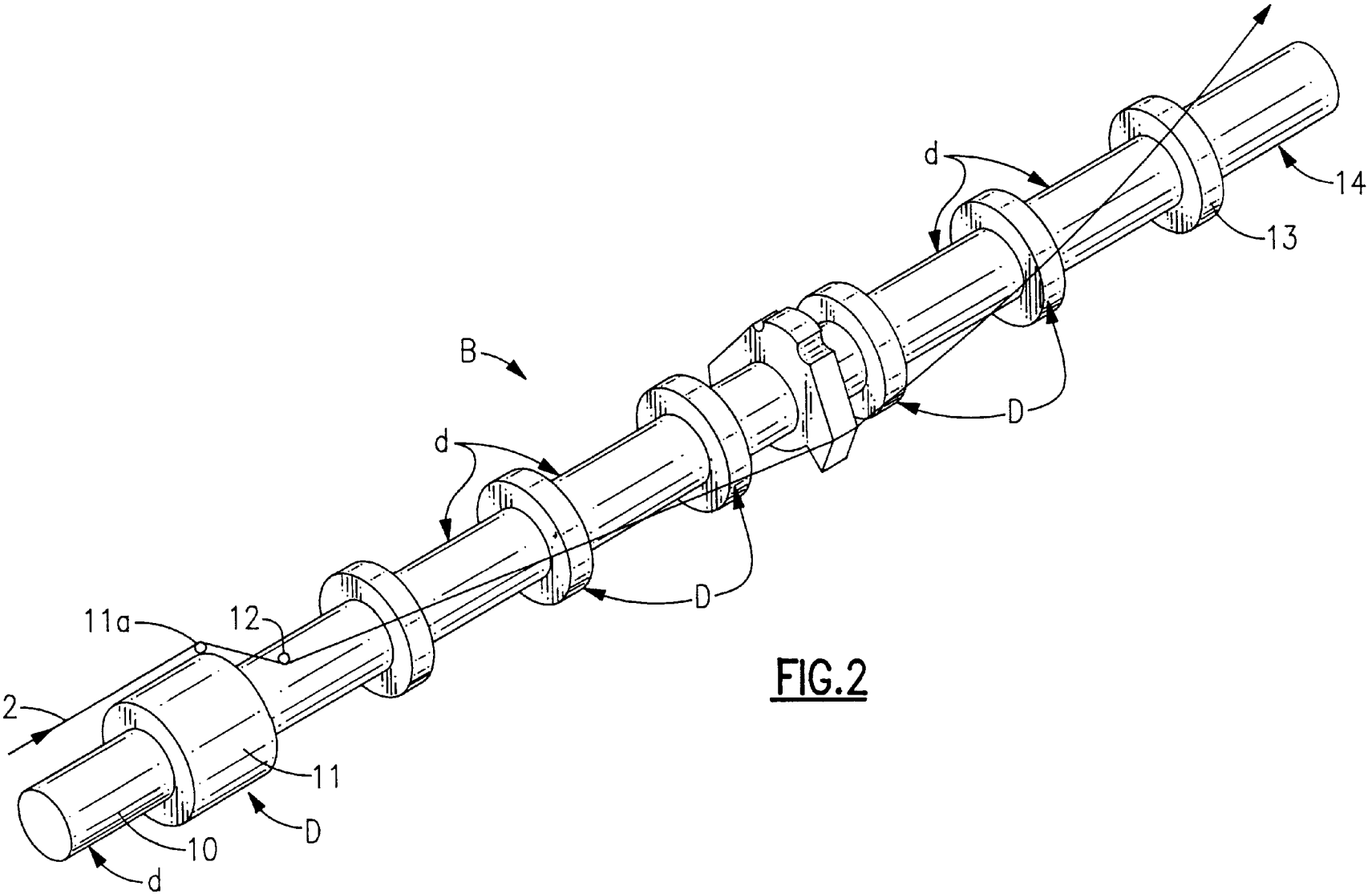
FIG. 2 illustrates, in diagrammatic perspective, the structure of an oven, which also forms part of the invention, especially adapted so as to localize the point of striction of the yarn while it is being drawn, in accordance with the invention, this figure showing the trajectory of the yarn as it passes through the oven.

In accordance with the invention, the heater unit (B) is designed, going along the trajectory of the yarn (2), in such a way that it includes an entry zone (10), for heating by radiation, followed by a first zone (11) for heating by contact. Immediately downstream of the zone (11) for heating by contact is arranged a guide (12) which enables the point of striction on the yarn to be localized by modifying the trajectory without, however, preventing the twist imparted by the spindle (6) from going back, the said trajectory subsequently becoming uniform again, whether rectilinear or curvilinear as shown in FIG. 2, right up to the point where it leaves the oven, with an alternation of heating zones for heating by contact and by radiation. Preferably, the final zone (13) for heating by contact is followed by a zone (14) for heating by radiation.

Figure 3:
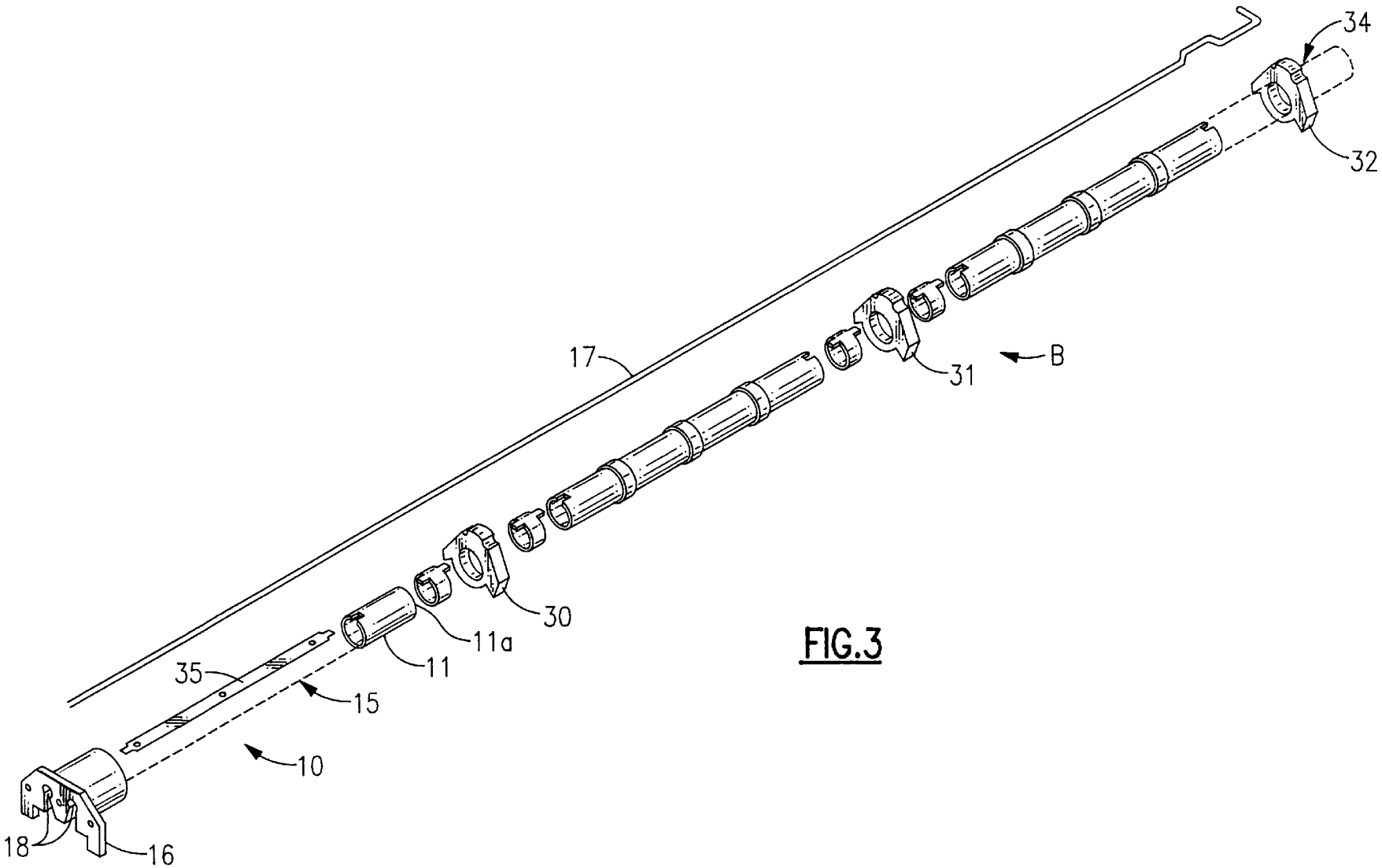
FIG. 3 is an exploded perspective view showing in detail the heating element of an oven especially designed to implement the process in accordance with the invention.
Figure 4:
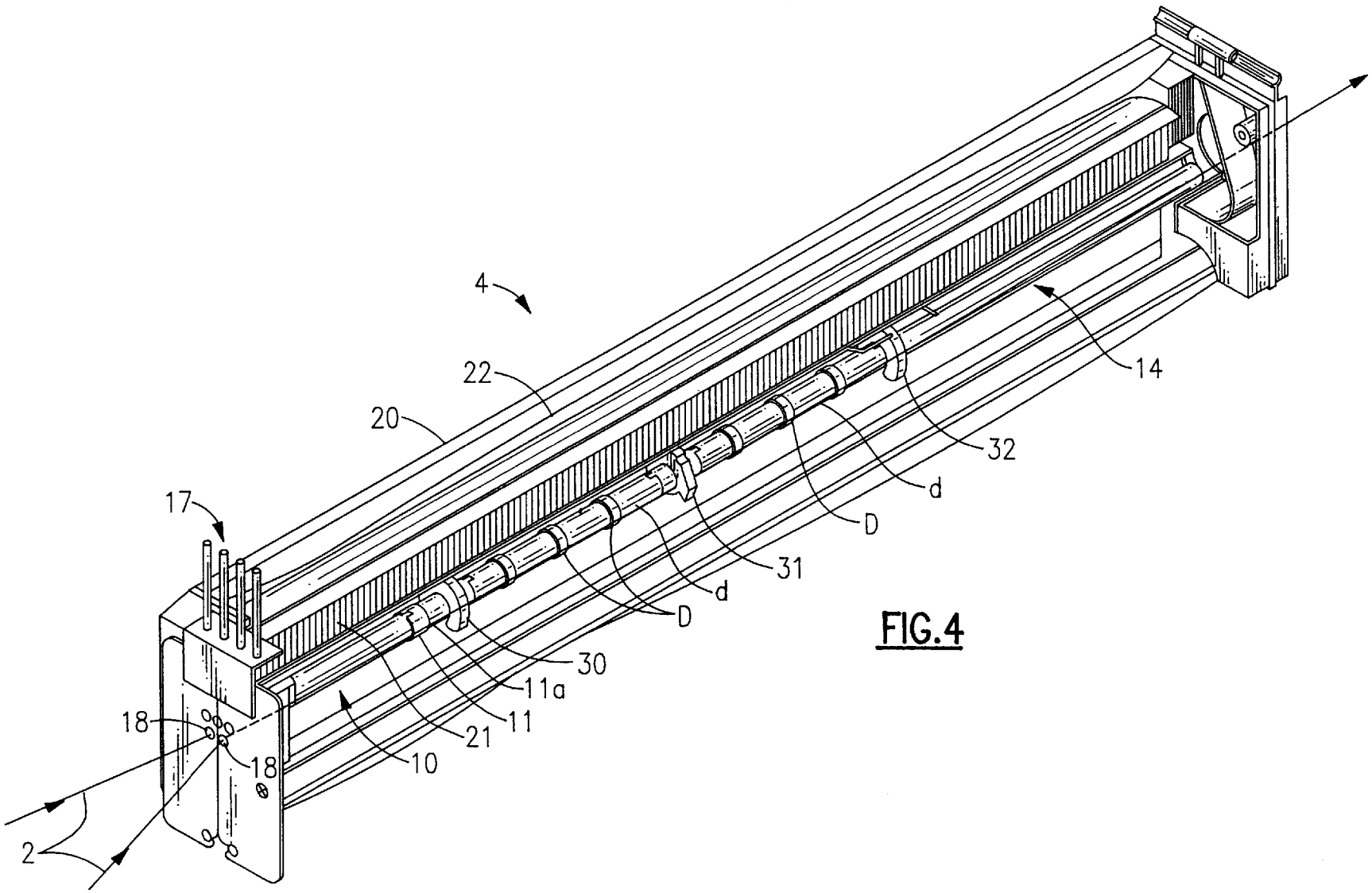
FIGS. 4 and 5 are respectively views, in exploded perspective and in sectional elevation, of an oven including a heating element produced in accordance with FIG. 3.
Figure 5:
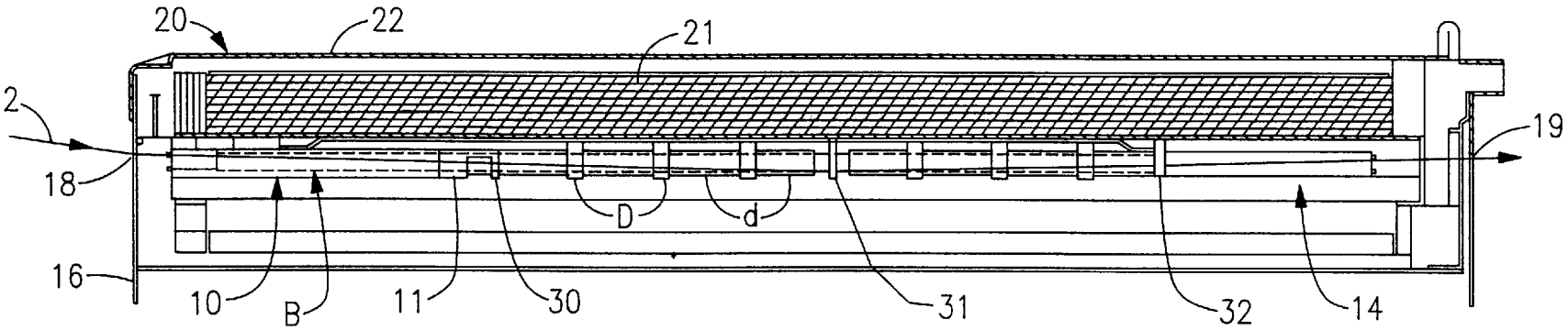

FIGS. 3, 4 and 5 illustrate in detail an oven implementing the process in accordance with the invention, having the general structure of the type of that forming the subject of U.S. Pat. No. 5,332,882 (EP-A-578,589).

It is essentially composed (see FIGS. 4 and 5) of an insulating chamber designated by the general reference (20) and which consists of a refractory block (21) surrounded by an external shroud (22) which surrounds a heater unit (BQ) produced in accordance with the invention with which the chamber defines a longitudinal channel through which the yarn to be treated passes.

In the present case, the oven enables two yarns (2) to be treated in parallel.

The insulating block (21), made of refractory material, advantageously has a cylindrical shape and includes a recess, of cylindrical shape, intended to contain the heating element (B) which has a structure as illustrated in an exploded manner in FIG. 3.

In this embodiment, the heating element (B) is fixed via one of its ends to one of the end faces (16) of the shroud, this face being removable and supporting connections (17) making it possible to provide the electrical supply for the oven and its control.

The heater unit (B) is designed so as to have a succession of zones having different diameters D and d, in such a way that the yarns (2) are in contact with the zones of large diameter D, the heat transfer then taking place by conduction, and are held away from the zones of smaller diameter d, the heat transfer then taking place by radiation.

The yarns (2) are guided and positioned inside the oven, between the point of entry through little holes (18) provided on the face (16) and the point of exit through little holes (19) provided at the other end of the oven, by means of guides (30, 31, 32). These guides are distributed over the length of the heating assembly and make it possible to define the path of the yarns so that it is, for example, rectilinear over part of the length of the oven, in the present case in the entry zone (10) and the exit zone (14), and then in the form of a helix in one or more successive zones, in the present case in the two middle zones.

In accordance with the invention, the yarns are in tangential contact with the zones of large diameter D where they are heated by contact and are held away from the surface of the zones of small diameter d where the heating takes place by radiation.

For the implementation of the process in accordance with the invention, in such an embodiment, the trajectory of the yarn inside the oven is abruptly changed by combining the first module (11) of diameter D with the first guiding element (30) which is designed so as to deflect the yarn over the edge **(11*a*) of the module (11) and which therefore serves as a guide (12), thus making it possible to localize the point of striction in this zone. The length of the zone where the yarn is in contact with this first module (11)** can vary depending on the nature of the yarns and will, in general, be of the order of 2 to 10 cm.

In such a type of oven, the heating element (B) is designed in a manner such as that shown diagrammatically in FIG. 3, and is essentially composed of a cylindrical heater (15), shown by the dotted lines, comprising one or more resistors embedded in a matrix obtained by moulding. This heater also includes a thermocouple element enabling the temperature to be accurately controlled. Depending on the treatments to be carried out, the resistors may be designed in different ways, for example so as to have a constant temperature over the entire length of the oven or to have variable temperatures, in which case it will be possible, for example, to arrange two resistors in parallel which may either have the same length or be staggered, one with respect to the other over the length of the oven.

In this embodiment, in order to produce a succession of zones of different diameters, elementary modules are used whose length may be adapted depending on the treatments to be carried out, which modules may be fitted together by sliding over the heater (10) and which form cylindrical surfaces of different diameters D and d. Each module may either form itself a zone of small diameter d, or a zone of large diameter D, or may possibly combine an alternation of zones of large diameter D and of zones of small diameter d, as illustrated in FIG. 3.

The internal diameter of each module corresponds to the external diameter of the heating resistor (15) so that the modules may be fitted together simply by sliding over the latter.

By virtue of this design, it is possible to adapt the structure of the oven according to the heat treatment to be carried out and to the type of yarn to be treated.

The various modules and guides are held in position around the heater (10) by any suitable means, for example by means of a locking ring or by means of screws, the various modules being prevented from moving longitudinally by means of a tie rod (17) fastened to the entry face (16), the end (33) of which tie rod snaps into a notch (34) provided in the exit guide (32). The positioning of the first module (11) with respect to the oven entry is adjusted by means of a spacer (35) of suitable length, making it possible to define an entry zone (10), where the heating takes place by radiation, which may have a length adapted according to the requirements.

By virtue of such a design, the heater may be easily adapted to the treatment conditions and to the materials to be treated by modifying the length of the zones of large diameter D and of small diameter d1 and by modifying the position of them over the length of the oven.

Such a type of oven makes it possible to carry out a drawing/texturizing operation on any type of man-made yarn, including polyester yarn, the point of striation of the yarn being completely localized during the drawing phase.

The implementation of the process in accordance with the invention will, however, become more apparent from the specific embodiment example given hereinbelow by way of non-limiting indication.

EXAMPLE

A partially oriented polyester yarn, having a linear density of 167 dtex before treatment and comprising 34 filaments, is treated in a false-twist-texturizing machine as illustrated in FIG. 1.

This machine is equipped with a high-temperature oven 100 cm in length, having a structure as shown diagrammatically in FIG. 2, which includes a 20-cm long entry zone (10) allowing heating by radiation followed by a 2-cm zone (11) of diameter D for heating by contact. Right after this zone (11) for heating by contact, the trajectory of the yarn (2) is deflected by the guide (30), which therefore results in a deviation with respect to the said surface (11) enabling the point of striction to be localized. Downstream of the deflecting guide (30) are arranged a succession of zones of diameter D and of diameter d having respectively a length of 1.2 cm and 5.5 cm, the trajectory of the yarn being uniform, whether rectilinear or curvilinear, right up to the point where it leaves the oven. The final zone (13) of diameter D is followed by a zone (14) of diameter d having a length of 16 cm, where heating takes place by radiation.

The heating element embedded in the heater unit, this element not being shown in the appended FIG. 2, is heated to a temperature of 600° C.

The oven is followed by a 1.25-metre long cooling zone (5) and an external friction false-twist spindle (6), rotating at a speed of 11,000 revolutions per minute, composed of ceramic discs.

The speed of the output delivery unit (7) is adjusted to 1000 m/min, allowing a draw ratio of 1.73.

Arranged downstream of the delivery unit (7) is a conventional setting oven, not shown in FIG. 1, having a length of 1.20 m and heated to a temperature of 200° C.

The wind-up speed is 980 m/min.

Carrying out the process in this manner, a yarn is obtained which has the following properties:

strength: 650 g elongation: 22% elasticity: 27% crimp: 18% stability: 85%.

The machine in accordance with the invention avoids broken ends in industrial production and allows very uniform production between the various treatment positions from one machine to another.

We claim:

1. A drawing/false-twist yarn texturing process capable of being implemented on a machine which includes a creel for supplying unoriented or partially oriented yarn to be treated and a plurality of identical work positions mounted on a support frame, each position in the direction of movement of the yarn during its treatment comprising:

a first feed system enabling the yarn to be delivered at a predetermined speed into a texturing zone proper, which zone consists of an oven, a cooling rack and a false-twisting spindle;

a second feed, the speed of which is greater than the first, having a value corresponding to the degree of drawing to be carried out on the yarn;

means for winding up the drawn and textured yarn, these optionally being preceded by a heat resetting oven with a third feed arranged immediately in front of the means for winding up the textured yarns; and characterized in that the point of striction on the yarn during the drawing is localized by bringing about a sudden break or modification in the trajectory of the yarn while it is rising in temperature in the texturing zone, this being achieved by pressing on a surface or element associated with a guide enabling the yarn to be deflected agzainst the further edge of said surface and allowing the twist imparted by the spindle to be taken back as far as the first feed system, said break of modification in the trajectory of the yarn being carried out within the actual oven, either while the yarn is rising in temperature or in the vicinity of the zone where it reaches, within the oven, its optimum treatment temperature.

2. An oven for implementing the process according to claim 1 comprising:

a heater unit wherein a succession of cylindrical zones having different diameters which are arranged directly in line with one another, the yarn to be treated being held at a constant distance from the external surface of the zones of smaller diameter in such a way that the temperature rise of the yarn in these zones occurs by radiation;

wherein said yarn comes into contact with the surface of the zones of larger diameter, the heat transfer then taking place by contact; yarn-guiding elements being provided over the length of the oven in order to position the yarn;

characterized in that it includes guiding the trajectory of the yarn, an entry zone, where the heating takes place by radiation, followed by a zone for heating by contact, after which zone means are arranged enabling the trajectory of the yarn to be suddenly modified said means comprising a guide enabling the yarn to be deflected against the further edge of the zone for heating by contact without, however, preventing the twist from going back;

the said trajectory subsequently becoming uniform again, whether rectilinear or curvilinear, the yarn then being subjected to a succession of heat treatments by contact and by radiation right up to the point where it leaves the oven, the final zone advantageously consisting of a zone for heating by radiation.

3. An oven according to claim 2 wherein the zones of different diameter enable a combination of heating by radiation and heating by contact to be achieved, consisting of a plurality of elementary modules juxtaposed by fitting together on the cylindrical heater, fixed via one of its ends to a removable face of the oven shroud, the modules juxtaposed along the heater being held in position by a positioning and locking element which is itself fastened to the removable face.

4. An oven according to claim 2 which is designed for treating two yarns in parallel, with the yarns being guided and positioned inside the oven, between the point of entry through small holes provided on the face and the point of exit through small holes provided at the other end of the oven by means of guides distributed over the length of the heating assembly.

5. A heating device according to claim 2, characterized in that the trajectory of the yarn inside the oven is modified by means of a module having a predetermined diameter associated with a guide thereby enabling the yarn to be deflected against the further edge of the said first module.

* * * * *

UNITED STATES PATENT AND TRADEMARK OFFICE

CERTIFICATE OF CORRECTION

PATENT NO. : 5,918,455
DATED : July 6, 1999
INVENTOR(S) : Carlos Gabalda, et al.

It is certified that error appears in the above—identified patent and that said Letters Patent is hereby corrected as shown below:

CLAIMS

Claim 1.

Column 8, Line 2, please delete the word "agzainst" and please insert the word --against--

Signed and Sealed this

Seventh Day of December, 1999

*Attest:*

Q. TODD DICKINSON

*Attesting Officer*

*Acting Commissioner of Patents and Trademarks*